United States Patent [19]

Fukuo

[11] Patent Number: 4,926,804

[45] Date of Patent: May 22, 1990

[54] MECHANISM FOR SWITCHING VALVE OPERATING MODES IN AN INTERNAL COMBUSTION ENGINE

[75] Inventor: Koichi Fukuo, Saitama, Japan

[73] Assignee: Honda Giken Kogyo Kabushiki Kaisha, Tokyo, Japan

[21] Appl. No.: 356,915

[22] Filed: May 23, 1989

[30] Foreign Application Priority Data

May 23, 1988 [JP] Japan ..... 63-125437

[51] Int. Cl.[5] ..... F01L 1/34

[52] U.S. Cl. ..... 123/90.16; 123/90.44; 123/90.17

[58] Field of Search ..... 123/90.16, 90.17, 90.39, 123/90.4, 90.44

[56] References Cited

U.S. PATENT DOCUMENTS

| | | | |
|---|---|---|---|
| 4,535,732 | 8/1985 | Nakano et al. | 123/90.16 |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/90.16 |
| 4,576,128 | 3/1986 | Kenichi | 123/90.16 |
| 4,587,936 | 5/1986 | Matsuura et al. | 123/90.46 |
| 4,612,884 | 9/1986 | Ajiki et al. | 123/90.16 |
| 4,656,977 | 4/1987 | Nagahiro et al. | 123/90.16 |
| 4,726,332 | 2/1988 | Nishimura et al. | 123/90.16 |
| 4,727,830 | 3/1988 | Nagahiro et al. | 123/90.16 |
| 4,727,831 | 3/1988 | Nagahiro et al. | 123/90.16 |
| 4,741,297 | 5/1988 | Magahirox et al. | 123/90.16 |
| 4,768,467 | 9/1988 | Yamada et al. | 123/90.16 |
| 4,768,475 | 9/1988 | Ikemura | 123/90.16 |

*Primary Examiner*—Charles J. Myhre
*Assistant Examiner*—Weilnn Lo
*Attorney, Agent, or Firm*—Lyon & Lyon

[57] ABSTRACT

A mechanism for switching valve operating modes in an internal combustion engine that has a valve operating mechanism with high- and low-speed cams having different cam profiles corresponding to rotational speed ranges of the engine, a pair of valves disposed in intake or exhaust ports of a combustion chamber and a normally urged to be closed by spring means, a directly moving transmitting member for imparting the lift of the low-speed cam to the valve, a pair of idling transmitting members for transmitting the lift of said high-speed cam on the pair of valves and a selective coupling mechanism for selectively connecting the transmitting members when mutually adjacent portions of the transmitting members are in a predetermined positional relationship. The diameter of the base-circle portion of the high-speed cam is smaller than the diameter of the base-circle portion of the low-speed cam whereby the selective coupling mechanism may be readily operated to connect the transmitting members without compressing the valve springs.

9 Claims, 5 Drawing Sheets

MECHANISM FOR SWITCHING VALVE OPERATING MODES IN AN INTERNAL COMBUSTION ENGINE

The present invention relates to a switching device for varying the operation of an intake or exhaust valve depending on the rotational speed of an internal combustion engine.

Each of the combustion chambers of a four-cycle internal combustion engine has intake and exhaust valves for drawing an air-fuel mixture into and discharging burned gases from the combustion chamber at prescribed timing. These valves are normally urged to a closed position by valve springs disposed around respective valve stems of the valves. The valves are forcibly opened against the bias of the valve springs by cams integrally formed with camshafts which are rotated by the crankshaft of the engine through a belt and pulley mechanism.

There have been proposed various arrangements for varying the operation of the valves depending on the rotational speed of the engine in order to increase the efficiency with which an air-fuel mixture is charged into the combustion chamber over a wide range of driving conditions. One such device for switching valve operation modes is disclosed in Japanese Laid-Open Patent publication No. 63-16111, for example. The disclosed switching device has a pair of low-speed cams associated with a pair of intake or exhaust valves, respectively, each having a cam profile corresponding to a low-speed operation range of an engine, and a single high-speed cam having a cam profile corresponding to a high-speed operation range of the engine. The cams are integrally formed on a camshaft which is rotatable about its own axis in synchronism with rotation of the engine. The switching device also includes a pair of directly moving rocker arms held in slidable contact with the low-speed cams, respectively, and operatively coupled to the intake or exhaust valves, and an idling rocker arm held in slidable contact with the high-speed cam, with the rocker arms mounted in mutually adjacent relation on a rocker shaft for relative angular displacement. A selective coupling means is disposed in the rocker arms for switching between a mode in which the rocker arms are coupled to each other for movement in unison and another mode in which the directly moving and idling rocker arms are relatively angularly displaceable. The selective coupling means comprises pistons slidably fitted in guide holes defined in the rocker arms, the pistons being movable under hydraulic pressure into positions across adjacent sides of the rocker arms for interconnecting the rocker arms.

According to the above arrangement, the rocker arms are interconnected by displacing the pistons into positions extending across the adjacent sides of the rocker arms when the cam slippers of the rocker arms are in sliding contact with the base-circle portions of the respective cams. For smooth operation of the pistons, therefore, it is necessary that the guide holes in the rocker arms be held in precise coaxial relationship with each other. However, this requirement demands complex quality control.

It has been proposed in Japanese patent application No. 63-336596 to make the guide hole in the idling rocker arm slightly larger than the guide holes in the directly moving rocker arms in order to allow smooth switching operation without a high standard of accuracy of coaxial relationship between the guide holes in the rocker arms. The proposed switching device provides a clearance between the guide hole and the pistons for absorbing any dimensional error between the directly moving rocker arms and the idling rocker arm. The clearance may however result in a large play which tends to reduce the effective lift of the high-speed cam and/or produce cam noise in the high-speed range.

In view of the aforesaid drawbacks of the conventional valve operation mode switching devices, it is an object of the present invention to provide a device for switching valve operation modes in an internal combustion engine, which device allows smooth operation of a selective coupling mechanism without excessively increasing the tolerance between pistons and guide holes of the selective coupling mechanism.

According to the present invention, the above object can be accomplished by a mechanism for switching valve operation modes in an internal combustion engine having high- and low-speed cams with different cam profiles corresponding to rotational speed ranges of the engine, a valve disposed in an intake or exhaust port of a combustion chamber and normally urged to a closed position by spring means, a directly moving transmitting member for imparting the lift of the low-speed cam to the valve, an idling transmitting member for transmitting the lift of the high-speed cam to the valve, and selective coupling means for selectively connecting the transmitting members when mutually adjacent portions of the transmitting members are in a predetermined positional relationship, wherein the diameter of a base-circle portion of the high-speed cam is smaller than the diameter of a base-circle portion of the low-speed cam.

With the arrangement of this invention, the angle through which the idling transmitting member is freely swingable is increased toward the center of the camshaft having the high- and low-speed cams by the dimensional difference between the diameters of the base-circle portions of the high- and low-speed cams. Therefore, even if the directly moving transmitting member and the idling transmitting member are relatively displaced slightly from the predetermined positional relationship, the position of the idling transmitting member can easily be corrected by the bias of an idling urging means for urging the idling transmitting means against the high-speed cam.

A preferred embodiment of the present invention will hereinafter be described in detail with reference to the accompanying drawings, wherein.

Figure 1:
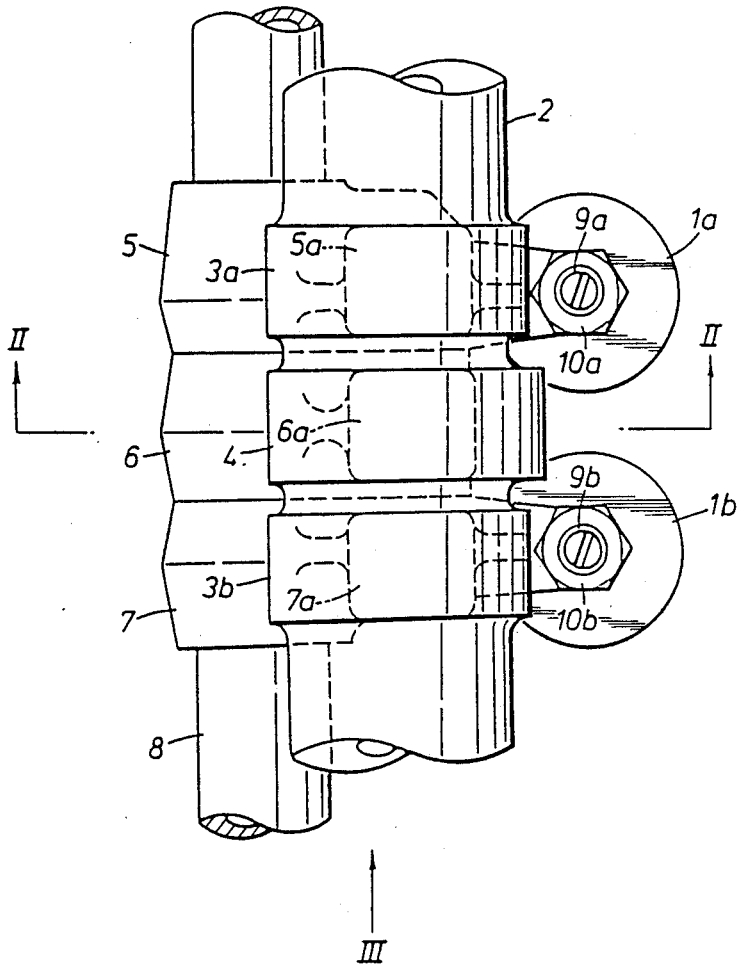
FIG. 1 is a fragmentary plan view of a valve operating mechanism having a valve operation mode switching mechanism according to the present invention.

As shown in FIG. 1, a pair of intake valves 1*a*, 1*b* are mounted in the body of an internal combustion engine (not shown). The intake valves 1*a*, 1*b* are opened and closed by a pair of low-speed cams 3*a*, 3*b* and a single high-speed cam 4 which have appropriate cam profiles and are integrally formed on a camshaft 2 rotatable by the crankshaft of the engine at a speed ratio of ½ with respect to the speed of rotation of the crankshaft. A pair of directly moving rocker arms 5, 7 engage the cams 3a, 3b and angularly movable as valve operation transmitting members. An idling rocker arm 6 engages the high-speed cam 4 for angular movement. The internal combustion engine also has a pair of exhaust valves (not shown) which can be opened and closed in the same manner as the intake valves 1a, 1b.

The rocker arms 5, 6, 7 are pivotally supported in mutually adjacent relation on a rocker shaft 8 extending below and parallel to the camshaft 2. The directly moving rocker arms 5, 7 are basically of the same configuration. The rocker arms 5, 7 have proximal ends supported on the rocker shaft 8 and free ends extending above the intake valves 1a, 1b, respectively. Tappet screws 9a, 9b are adjustably threaded through the free ends of the directly moving rocker arms 5, 7 to engage the upper ends of the intake valves 1a, 1b. The tappet screws 9a, 9b are prevented from loosening by respective locknuts 10a, 10b.

Figure 2:
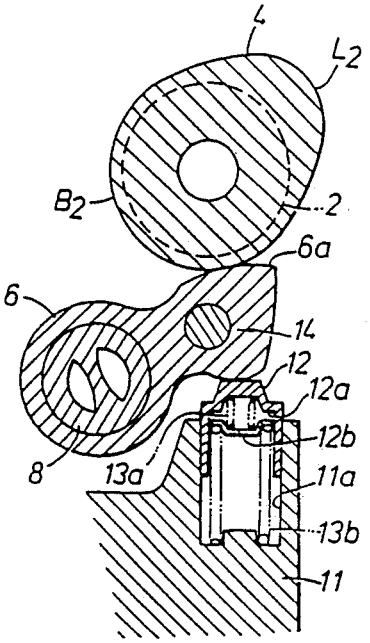
FIG. 2 is a cross-sectional view taken along line II—II of FIG. 1.

The idling rocker arm 6 is pivotally supported on the rocker shaft 8 between the directly moving rocker arms 5, 7. The idling rocker arm 6 extends from the rocker shaft 8 or short distance to a position intermediate the intake valves 1a, 1b. As better shown in FIG. 2, the idling rocker arm 6 has on its upper surface a cam slipper 6a held in slidable contact with the high-speed cam 4, and also has its lower surface held in abutment against the upper end of a lifter 12 slidably fitted as an idling rocker arm urging means in a guide hole 11a defined in a cylinder head 11.

The lifter 12 is in the form of a bottomed cylinder and has a reduced-diameter bottom with a step 12a on its inner surface. The lifter 12 houses therein a small-diameter spring 13a having a relatively small spring constant and a larger-diameter spring 13b having a relatively large spring constant. The springs 13a, 13b are held under compression with a retainer 12b sandwiched therebetween. The idling rocker arm 6 is normally urged resiliently by the lifter 12 to hold the cam slipper 6a in slidable contact with the high-speed cam 4.

Figure 3:
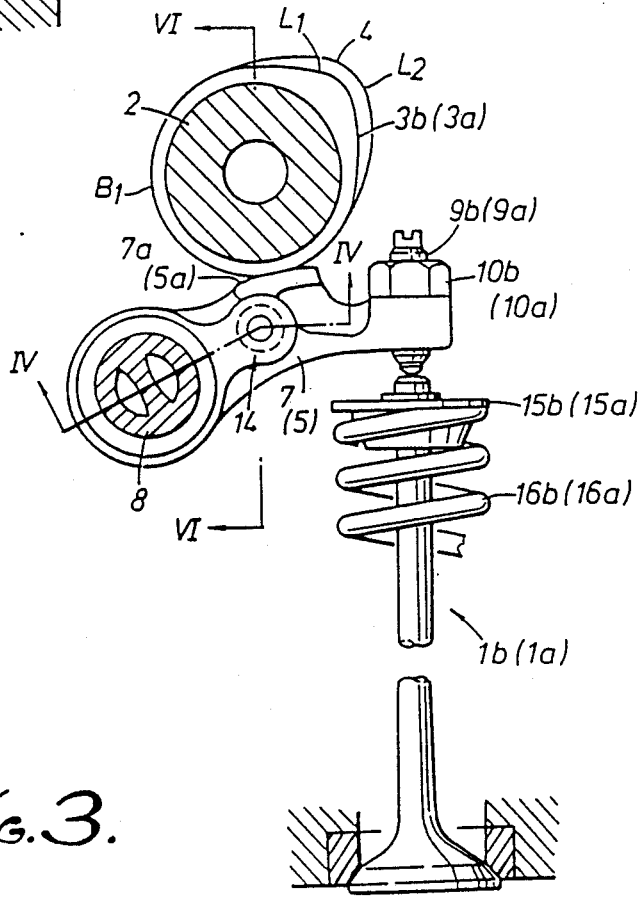
FIG. 3 is a cross-sectional view of the valve operating mechanism as viewed along the arrow III in FIG. 1.

As described above, the camshaft 2 is rotatably supported above the engine body, and has integrally thereon the low-speed cams 3a, 3b and the high-speed cam 4. As shown in FIG. 3, the low-speed cams 3a, 3b have a cam profile matching a low-speed range of the engine and composed of a base-circle portion B1 that is basically defined by a true circle and a cam lobe L1 having a relatively small cam lift. The outer peripheral surfaces of the low-speed cams 3a, 3b are held in slidable contact with cam slippers 5a, 7a on the upper surfaces of the directly moving rocker arms 5, 7, respectively. The high-speed cam 4 has a cam profile matching a high-speed range of the engine and composed of a base-circle portion B2 that is basically defined by a true circle and a cam lobe L2 having a higher cam lift and a greater angular extent than those of the low-speed cams 3a, 3b. The outer peripheral surface of the high-speed cam 4 is held in slidable contact with the cam slipper 6a of the second rocker arm 6. The lifter 12 is omitted from illustration in FIG. 3.

The rocker arms 5, 6, 7 can be selectively switched between a mode in which they are swingable in unison and another mode in which they are relatively displaceable, by a selective coupling mechanism 14 (described later) mounted in holes defined as engaging portions centrally through the rocker arms 5 through 7 parallel to the rocker shaft 8.

Retainers 15a, 15b are mounted on the upper ends of the valve stems of the intake valves 1a, 1b, respectively, valve springs 16a, 16b are disposed around the valve stems of the intake valves 1a, 1b between the retainers 15a, 15b and the engine body for normally urging the valves 1a, 1b upwardly (as viewed in FIG. 3) in a direction to close these valves.

Figure 4:
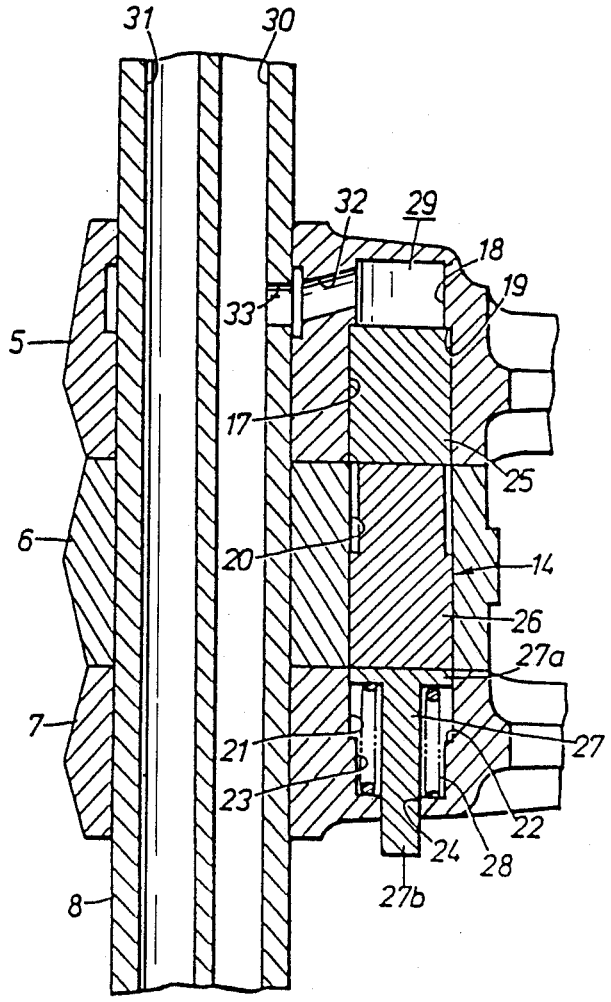
FIG. 4 is a cross-sectional view taken along line IV—IV of FIG. 3, showing a low-speed mode of operation.
Figure 5:
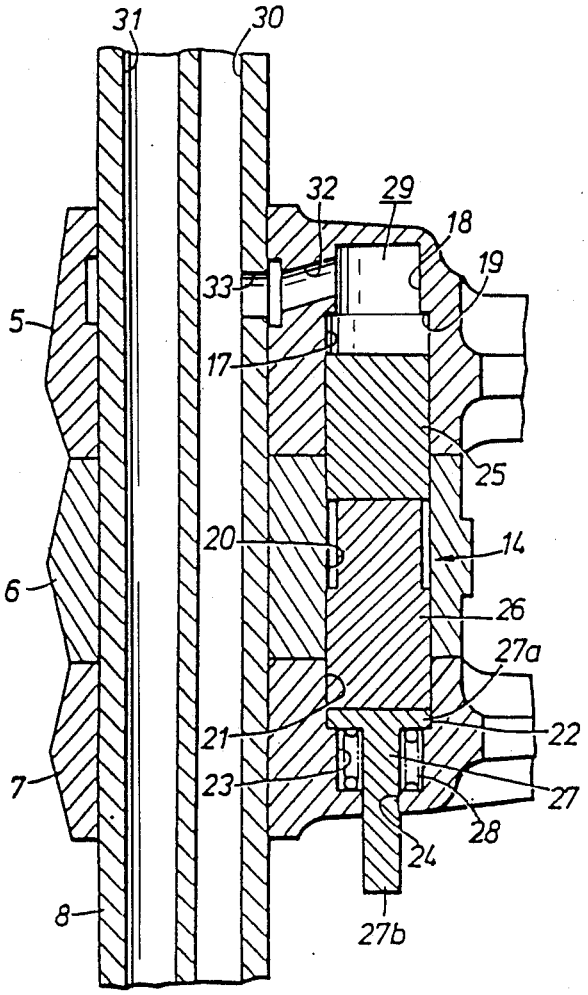
FIG. 5 is a view similar to FIG. 4, showing a high-speed operation mode.

The selective coupling mechanism 14 is illustrated in FIGS. 4 and 5. The first directly moving rocker arm 5 has a first guide hole 17 defined therein parallel to the rocker shaft 8 and opening toward the idling rocker arm 6. The rocker arm 5 also has a smaller-diameter hole 18 defined in the bottom of the first guide hole 17 with a step 19 therebetween. The idling rocker arm 6 has a second guide hole 20 defined therethrough between the opposite sides thereof and held in communication with the first guide hole 17 in the rocker arm 5. The second directly moving rocker arm 7 has a third guide hole 21 communicating with the second guide hole 20. The rocker arm 7 also has a smaller-diameter hole 23 defined in the bottom of the third guide hole 21 with a step 22 therebetween, and a through hole 24 defined in the bottom of the smaller-diameter hole 23.

The first, second, and third guide holes 17, 20, 21 house therein a first piston 25 movable between a position in which it connects the first directly rocker arm 5 and the idling rocker arm 6 and a position in which it disconnects the rocker arms 5, 6, a second piston 26 movable between a position in which it connects the idling rocker arm 6 and the second directly moving rocker arm 7 and a position in which it disconnects the rocker arms 6, 7, a stopper 27 for limiting the distance over which the pistons 25, 26 are movable, and a coil spring 28 for normally urging the stopper 27 and pistons 25, 26 in a direction to disconnect the rocker arms 5, 6, 7.

The first piston 25 is slidably fitted in the first and second guide holes 17, 20 and defines a hydraulic pressure chamber 29 between the bottom of the first guide hole 17 and the end surface of the first piston 25. The rocker shaft 8 has a pair of oil supply passages 30, 31 defined axially therein and communicating with a hydraulic pressure supply (not shown). Working oil supplied from the working oil supply passage 30 is introduced into the hydraulic pressure chamber 29 through an oil passage 32 defined in the first directly moving rocker arm 5 in communication with the hydraulic pressure chamber 29 and a communication hole 33 defined in the peripheral wall of the rocker shaft 8. Through an annular passage in the rocker arm 5 whereby such communication is continuous regardless of the angular position of the first directly moving rocker arm 5. The internal surfaces of the rocker arms 5 through 7 which are pivotally supported on the rocker shaft 8 are lubricated continuously by lubricating oil supplied from the lubricating oil supply passage 31.

The first piston 25 has an axial dimension such that when one end thereof abuts against the step 19 in the first guide hole 17, the other end of the first piston 25 does not project beyond the side of the first directly moving rocker arm 5 which faces the idling rocker arm 6. The second piston 26 has an axial dimension which is substantially equal to the entire length of the second guide hole 20, and a portion with a diameter that is slidably fitted into the second and third guide holes 20, 21.

The stopper 27 has on one end thereof a disc 27*a* slidably fitted in the third guide hole 21 and on the other end thereof a guide rod 27*b* extending through a hole 24. A coil spring 28 is disposed under compression around the guide rod 27*b* between the disc 27*a* of the stopper 27 and the bottom of a smaller-diameter hole 23. The coil spring 28 is designed such that it flexes, or is compressed, when the hydraulic pressure in the hydraulic pressure chamber 29 reaches a predetermined level or higher.

Operation of the valve operation mode switching device now will be described. While the engine is operating in low- and medium-speed ranges, a control valve (not shown) is closed to cut off the supply of hydraulic pressure into the working oil supply passage 30. The pistons 25, 26 are positioned within the guide holes 17, 20, respectively, under the bias of the coil spring 28, as shown in FIG. 4. Therefore, the rocker arms 5, 6, 7 are angularly displaceable relatively to each other.

When the rocker arms 5, 6, 7 are disconnected from each other by the selective coupling 14, the first and second directly moving rocker arms 5, 7 are in sliding contact with and are pivoted by the low-speed cams 3*a*, 3*b* in response to rotation of the camshaft 2. As a result, the intake valves 1*a*, 1*b* are opened with delayed timing and closed with advanced timing, and opened to a smaller lift. At this time, the idling rocker arm 6 swings in sliding contact with the high-speed cam 4, but such swinging movement of the idling rocker arm 6 does not affect the operation of the intake valves 1*a*, 1*b*.

When the engine is operating in a high-speed range, the control valve is opened to supply hydraulic pressure into the hydraulic pressure chamber 19 in the selective coupling mechanism 14 through the working oil supply passage 30, the communication hole 33 in the rocker shaft 8, and the oil pressure 32. As shown in FIG. 5, the first piston 25 is moved toward the idling rocker arm 6 against the bias of the coil spring 28, pushing the second piston 26 toward the second directly moving rocker arm 7. As a result, the first and second pistons 25, 26 are moved until one end of the stopper 27 abuts against the step 22, whereupon the first directly moving rocker arm 5 and the idling rocker arm 6 are interconnected by the first piston 25, and the idling rocker arm 6 and the second directly moving rocker arm 7 are interconnected by the second piston 26.

With rocker arms 5, 6, 7 being thus coupled to each other by the selective coupling mechanism 14, because the idling rocker arm 6 is held in sliding contact with the high-speed cam 4 and therefore pivots to the largest extent, the first and second directly moving rocker arms 5, 7 are pivoted with the idling rocker arm 6. Therefore, the intake valves 1*a*, 1*b* are opened with advanced timing and closed with delayed timing, and opened to a larger lift, all according to the cam profile of the high-speed cam 4.

As described above, in the valve operating mechanism in the illustrated embodiment, two adjacent rocker arms are interconnected by a piston which is moved across the adjacent ends of guide holes in the rocker arms. If the adjacent guide holes were not accurately positioned coaxially with respect to each other, the piston will not be able to be moved into a position spanning the two guide holes.

If there is no tappet clearance between the tappet screws 9*a*, 9*b* on the directly moving rocker arms 5, 7 and the upper ends of the valve stems of the intake valves 1*a*, 1*b*, then the movement of the directly moving rocker arms 5, 7 is directly governed by the cam profile of the low-speed cams 3*a*, 3*b* and the valve springs 16*a*, 16*b* without the possibility of any play or lost motion.

The dimensions of the idling rocker arm 6, high-speed cam 4 and lifter 12 are such that when the idling rocker arm 6 slidingly contacts the base-circle portion B2 of the high-speed cam 4, the larger-diameter spring 13*b* in the lifter 12 extends to its full length in its free state and a gap is developed between the step 12*a* and the retainer 12*b* in the lifter 12. The idling rocker arm 6 is held in contact with cam 6 by spring 13*a*. Under this condition, therefore, it is possible to allow the idling rocker arm 6 to be angularly moved a small amount while compressing only the smaller-diameter spring 13*a* which has a relatively small spring constant.

Figure 6:
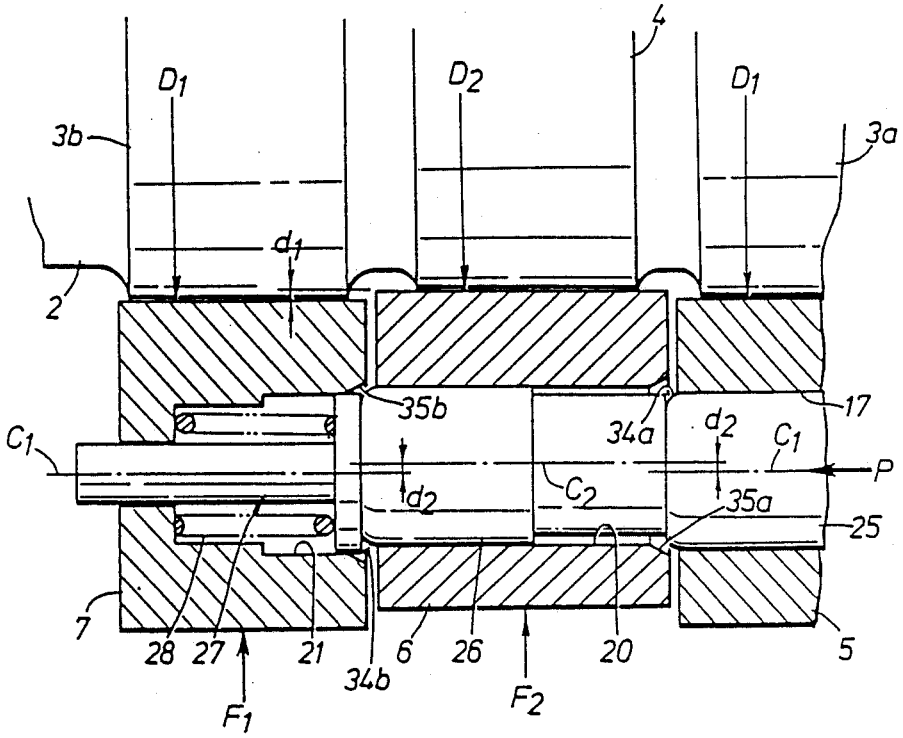
FIG. 6 is a fragmentary cross-sectional view taken along line VI—VI of FIG. 3, showing the relationship between various parts of the device.

In view of the above considerations, according to the present invention, the base-circle portion of the high-speed cam 4 has a diameter D2 which is smaller than the diameter D1 of the base-circle portion of each of the low-speed cams 3*a*, 3*b* b by a length d1, as shown in FIG. 6, so that the center C2 of the guide hole 20 in the idling rocker arm 6 is displaced by a distance d2 from the center C1 of the guide holes 17, 21 in the directly moving rocker arms 5, 7 toward the camshaft 2.

In order to permit the first piston 25 to be smoothly and reliably moved into the second guide hole 20 for interconnecting the rocker arms 5, 6, 7, the end of the first piston 25 which faces the idling rocker arm 6 has a partly spherical beveled surface 34*a* on its entire peripheral edge, and the end of the idling rocker arm 6 which faces the first directly moving rocker arm 5 has a tapered beveled surface 35*a* on the entire peripheral edge around the opening of the guide hole 20. Similarly, the end of the second piston 26 which faces the second directly moving rocker arm 7 has a partly spherical beveled surface 34*b* on its entire peripheral edge, and the end of the second directly moving rocker arm 7 which faces the idling rocker arm 6 has a tapered beveled surface 35*b* on the entire peripheral edge around the opening of the guide hole 21.

When the cam slippers 5*a*, 6*a*, 7*a* of the respective rocker arms 5, 6, 7 are held against the base-circle portions B1, B1, B2 of the cams 3*a*, 3*b*, 4, respectively, because the diameter D1 of the base-circle portions of the low-speed cams 3*a*, 3*b* and the diameter D2 of the base-circle portion of the high-speed cam 4 differ from each other by an amount d1, the center C2 of the guide hole 20 in the idling rocker arm 6 is displaced by the distance d2 from the center C1 of the guide holes 17, 21 in the directly moving rocker arms 5, 7 toward the camshaft 2, as described above. Now, if the first piston 25 is moved under the pressure P in the hydraulic pressure chamber 29 to push the second piston 26 in a direction out of the rocker arm 6, the directly moving rocker arms 5, 7 cannot be moved because of the substantial pushing force F1 applied thereto from the valve springs 16*a*, 16*b*, but the idling rocker arm 6 can be displaced downwardly by the first piston 25 entering the guide hole 20 since only the relatively small pushing force F2 is exerted on the idling rocker arm 6 by the smaller-diameter spring 13*a*.

By thus displacing the idling rocker arm 6 by the pistons 25, 26 entering the guide holes 20, 21, respectively, the second guide hole 20 is brought into axial alignment with the guide holes 17, 21, thereby assisting in smoothly connecting the rocker arms 5, 6, 7. When the cam lobe L2 of the high-speed cam 4 is slidably held against the cam slipper 6a, the smaller-diameter spring 13a is compressed until the step 12a of the lifter 12 abuts against the retainer 12b, and then the biasing force of the larger-diameter spring 13b acts on the lifter 12. Consequently, the idling rocker arm 6 is pressed against the high-speed cam 4 under a relatively large biasing force.

In contrast, in a valve operating mechanism of this type without the present invention, if the manufacturing tolerances or errors resulted in the second guide hole 20 having its center C2 displaced downward (in FIG. 6) from center C2 of the first and third guide holes 19, 21, the hydraulic pressure P may not be sufficient to push the first piston 25 into the second guide hole 20 and the second piston 26 into the third guide hole 21 in opposition to the substantial force F1 by the valve springs 16a, 16b because the rocker arms 5, 7 would have to be pivoted slightly for alignment.

In the illustrated embodiment, the three rocker arms are employed to switch the timing of operation of the two valves together. However, the principles of the present invention are also applicable to a valve operation mode switching device in which two or more rocker arms are employed and some of the rocker arms are independently movable in a certain speed range to separately operate the two valves differently.

With the present invention, as described above, even if dimensional errors in the valve operation mode switching device are accumulated, a displaced guide hole can be brought into axial alignment with other guide holes for allowing pistons to be moved therein. Therefore, it is possible to make dimensional tolerances of parts less strict to simplify quality control. The arrangement of the present invention is effective in reducing the cost of manufacture of valve operation mode switching devices.

What is claimed is:

1. In a mechanism for switching valve operation modes in an internal combustion engine having high- and low-speed cams with different cam profiles corresponding to rotational speed ranges of the engine, a valve disposed in an intake or exhaust port of a combustion chamber and normally urged to be closed by spring means, a directly moving transmitting member for imparting a lift of said low-speed cam to said valve, an idling transmitting member for transmitting a lift of said high-speed cam to said valve, and selective coupling means for selectively connecting both said transmitting members when mutually adjacent portions of both the transmitting members are in a predetermined positional relationship, an improvement comprising, The diameter of a base-circle portion of said high-speed cam being smaller than the diameter of a base-circle portion of said low-speed cam.

2. A mechanism according to claim 1, wherein said selective coupling means comprises an engaging portion defined on an axis extending across both said transmitting members, and a coupling member fittable into said engaging portion, at least one of an inlet opening of said engaging portion and an entering end of said coupling member having a tapered beveled surface.

3. A mechanism according to claim 2, wherein each inlet opening and entering end has a tapered, beveled surface.

4. A mechanism according to claim 1, wherein urging means are provided for continuous urging said idling transmitting means against said high-speed cam, said urging means including means for imposing a small urging force when said idling transmitting means engages said base-circle portion of said high-speed cam and a larger urging force when said idling transmitting means engages any other portion of said high-speed cam.

5. In a mechanism for switching valve operation modes in an internal combustion engine, having high- and low-speed cams with different cam profiles corresponding to rotational speed ranges of the engine and having base-circle portions, a valve disposed in an intake or exhaust port of a combustion chamber, a directly moving transmitting means engaging said low-speed cam for imparting a lift of said low-speed cam to said valve, an idling transmitting means engaging said high-speed cam for transmitting a lift of said high-speed cam to said valve, and selective coupling means for selectively connecting both said transmitting means when mutually adjacent portions of both the transmitting means are in a predetermined positional relationship, both said transmitting means having an ideal position of positional relationship wherein the selective coupling means is aligned for ready selective connecting, an improvement comprising both said transmitting means and said cams having predetermined dimensions for causing said idling transmitting means to be offset by a small amount from said ideal position in the direction of closing the valve when the directly moving and idling transmitting means are disconnected and engaging the cam base-circle portions.

6. A mechanism according to claim 5, wherein said selective coupling means comprises an engaging portion defined on an axis extending across both said transmitting means, and a coupling member fittable into said engaging portion, at least one of an inlet opening of said engaging portion and an entering end of said coupling member having a tapered beveled surface.

7. A mechanism according to claim 6 wherein said axes of both of said transmitting means are aligned in said ideal position.

8. A mechanism according to claim 5 wherein said selective coupling means include a piston slidably mounted in a guide hole in at least one of said transmitting means and movable into a guide hole in the remaining adjacent transmitting means for coupling both said transmitting means, said guide holes each having an axis, said guide hole axes being aligned in said ideal position and offset in the position of both the transmitting means while each is engaging a said cam base-circle portion.

9. A mechanism according to claim 5 wherein urging means are provided for continuously urging said idling transmitting means into engagement with said high-speed cam, said urging means including means for imposing a substantially lower urging force when said idling transmitting means engages said base-circle portion that when it engages a lobe of the high-speed cam.

* * * * *